US005485701A

United States Patent [19]

Hecht

[11] Patent Number: 5,485,701

[45] Date of Patent: Jan. 23, 1996

[54] TOY IGLOO

[76] Inventor: Thomas L. Hecht, 19 Deepwood Rd., Wilton, Conn. 06897

[21] Appl. No.: 300,759

[22] Filed: Sep. 6, 1994

[51] Int. Cl.[6] ..... E04B 1/32; A63H 33/32

[52] U.S. Cl. ..... 52/80.1; 52/80.2; 52/81.1; 52/592.1; 52/592.4; 425/DIG. 57; 446/70; 446/476

[58] Field of Search ..... 52/80.1, 80.2, 52/81.1, 81.4, 592.1, 592.4, 589.1; 446/70, 476, 491; 425/DIG. 57

[56] References Cited

U.S. PATENT DOCUMENTS 2,944,370 7/1960 Malarkey ..... 52/81.1
2,958,918 11/1960 MacMillan ..... 425/DIG. 57 X
3,284,969 11/1966 Walters et al. ..... 52/81.4
4,154,423 5/1979 Crock ..... 249/134
4,655,013 4/1987 Ritland ..... 52/81.4

*Primary Examiner*—Carl D. Friedman
*Assistant Examiner*—Christopher-Todd Kent
*Attorney, Agent, or Firm*—Edward R. Hyde

[57] ABSTRACT

A toy igloo construction for children consisting of a shell that is designed to collect falling snow. The shell serves as a support for the snow igloo and in addition may serve as a toy igloo in the absence of snow.

4 Claims, 2 Drawing Sheets

TOY IGLOO

BACKGROUND OF THE INVENTION

1. Field of the Invention

The present invention relates to a child's toy igloo and more particularly, to the construction of such an igloo. The invention provides a shell or mold by which a snow igloo that a child might play in may be constructed. The mold may be in sections and would include an igloo tunnel entrance way and a plurality of windows. It is contemplated that the mold would be constructed and left outdoors in the winter time so that when snow falls it would fall upon the igloo and be packed against it, resulting in an igloo in which children can play.

2. Description of the Prior Art

As distinguished from the summer time, there is a relatively small number of activities and toys that children can play outdoors in winter with other than the usual sleds and skates. However, when it snows, children proceed to take advantage of the snow by building snow forts, igloos, snowmen, and otherwise engage in snow activities.

Igloos, are quite difficult for children to build and they generally resort to assistance from their parents. For the igloo to be constructed there must be a significant amount of snow which is cut into blocks, packed somewhat, and then stacked in the hemispherical contour conventional to igloo formation. In addition to being somewhat difficut and time consuming to build the igloo can be quite dangerous to the child inside of it. If the construction is not solid, or if the snow blocks start to melt, the igloo structure will fall and could possibly collapse on children within. In addition, the constructed igloo will often not last very long if the weather gets a little warm and the snow blocks commence to melt.

It is to these problems of children's igloo construction that the present invention is directed, and accordingly a mold is provided to assist in building a child's igloo. It is realized that children's toy houses are well known and shown in the prior art as for example U.S. Pat. No. 5,205,772. However, neither this patent nor other prior art disclose or even contemplate a snow igloo mold as hereinafter described.

SUMMARY OF THE INVENTION

In view of the above described disadvantages and problems of building a toy snow igloo, the present invention provides an igloo shell or mold which is especially suited for snow collecting and packing, and provides a safe igloo construction for a child. Child's snow igloos are conventionally constructed as a hemisphere built up of snow blocks. The present mold contemplates a plurality of sections that when assembled provide a hemisphere of a size suitable for a child's igloo. The sections may be made of translucent white plastic and fit together at their edges in the construction of the unit. One section will have an opening for an entrance tunnel and other sections may have openings for windows. The sections may be formed so they nest together for convenient storage and joined together along their edges for convenient assembly.

The outer surfaces of the sections have appropriate indentations for snow packing and are roughened for collection of falling snow.

Accordingly it is a primary object of the present invention to provide a mold for a child's igloo that would be located outdoors to collect snow to form the igloo.

Another object of the present invention is to provide a mold for a child's igloo that results in a secure and safe structure.

A further object of the present invention is to provide a snow igloo construction that is convenient and easy for children to use.

A still further object of the present invention is to provide an igloo toy that can be used by a child throughout the winter as a toy igloo in heavy or light snow or no snow at all.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein which.

DESCRIPTION OF THE PREFERRED EMBODIMENT

Figure 2:
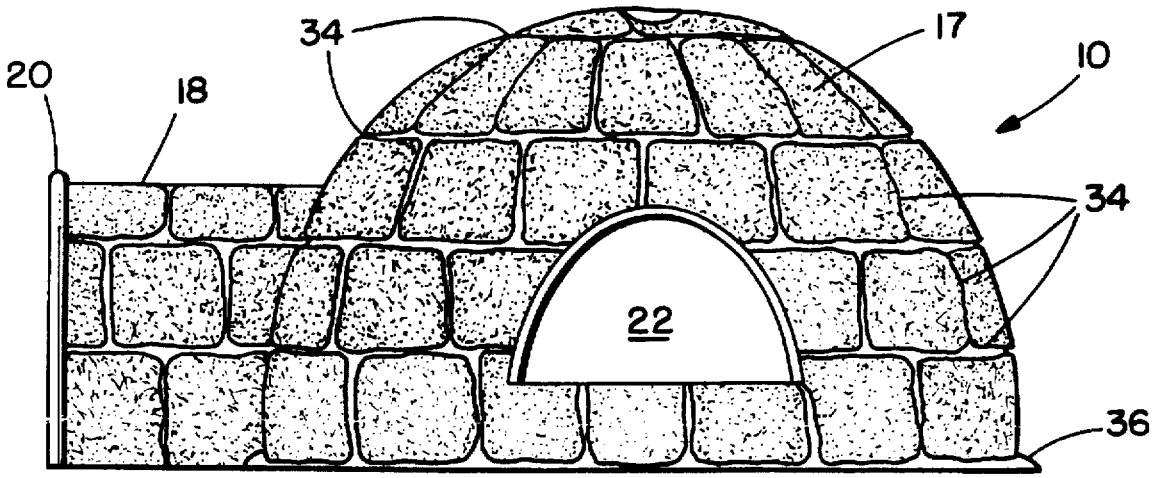
FIG. 2 is a side view of the mold of FIG. 1.
Figure 1:
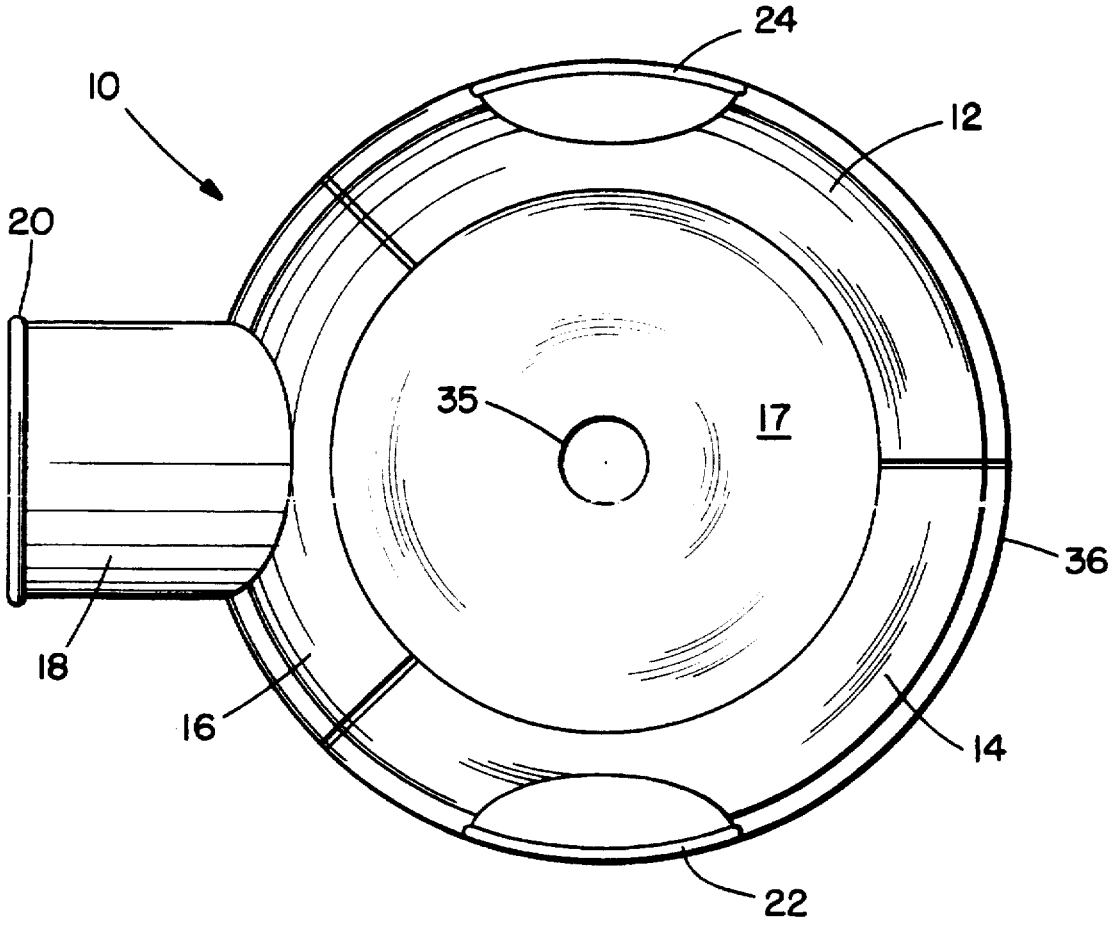
FIG. 1 is a top view of the igloo mold of the present invention.

Referring now to the drawing, numeral 10 indicates the mold or igloo shell of the present invention in its assembled condition. It is seen that the assembled mold is of generally hemispherical form to conform to igloo construction. The main body of the mold includes three lower sections, 12, 14, 16 and a dome 17 each of which is curved and form the basic hemisphere of the shell. It is, of course understood, that the body of the mold could be formed of any convenient number of sections and that four have been shown in the present embodiment. The sections may be made of transulcent, white elastic material.

Section 16 has an opening passing therethrough and connects to a mold section 18 which is somewhat semi cylindrical and forms an entrance way tunnel leading to the interior of the igloo. Section 18 would be preferably made of a single molded plastic element provided with a lip 20 at the outer edge and flaired outward to prevent the snow from sliding over the entrance opening.

Sections 12 and 14 each have an opening passing therethrough which is somewhat above the bottom or ground level and may be of semi-cylindrical shape as seen in FIG. 2. Each of the openings 22 and 24 have secured thereto at their curved upper edges a window element 26, 28 to complete the window construction. Each of the elements 26, 28 also contain a lip as 30 and 32 to assist in keeping the snow on top of the window elements and preventing from sliding into the windows.

The outer surface of the mold will have a grid of indentations 34 that simulate blocks of snow. The indentations have the important functional purpose of providing grooves to retain packed snow on the surface of the igloo. Further, the outer surface of the mold will be roughened to facilitate the adhesion of falling snow to the mold.

The top of the 17 dome will have a vent 35 to provide for the flow of air within the igloo. Further, the lower edge of the dome will have a flange 36 around the perimeter that will help stabilze the mold and keep it from pulling away from the snow once the igloo is completed.

It is seen that the present invention provides a device that would be used by a child in constructing an igloo.

The mold will be located outside in the winter especially if it is believed that a snow fall is eminent, Of course, even without snow the mold could be used as a toy igloo. When snow falls on the mold it will be retained to a large extent by the roughened surface of the plastic sections. Then as the snow builds up somewhat the child would pack it against the mold and the indentations 34 would assist in retaining the snow on the mold.

Figure 4:
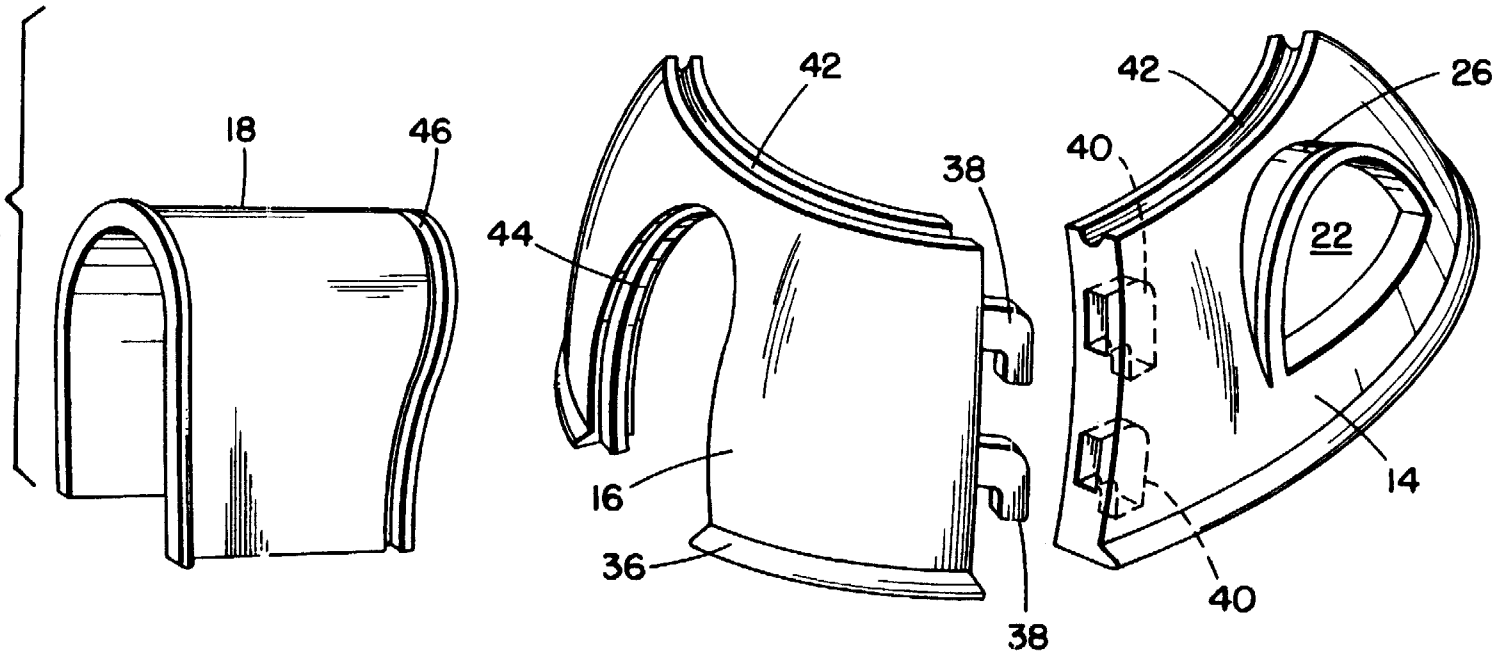
FIG. 4 is a detailed view of an arrangement for securing mold sections together.
Figure 3:
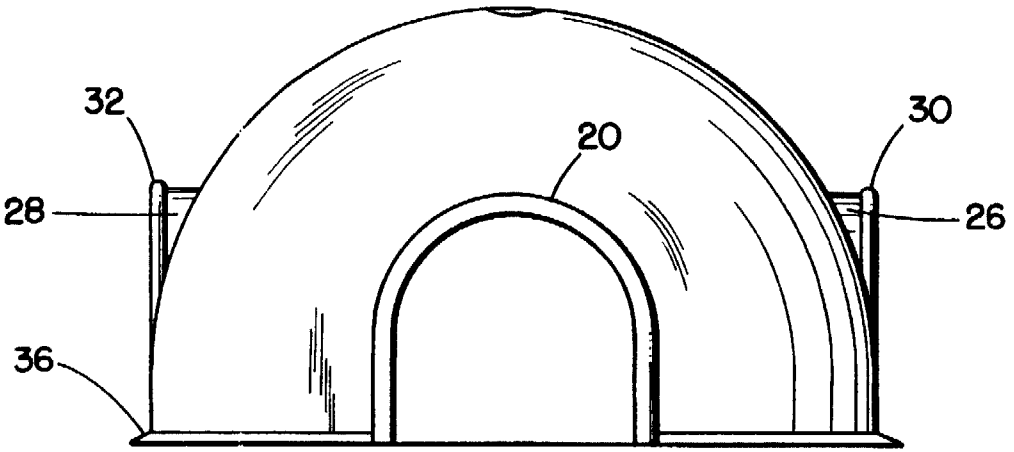
FIG. 3 is a front view of the mold.

The sections 12, 14, 16 may be secured together by an arrangement shown in FIG. 4. One side of each of these three sections may have a plurality of hook elements as 38 on the right hand edge of section 16. The left hand edge of section 14 has two hook shaped recesses 40 that receive hooks 38 when the two sections are brought together. In a similar manner, section 12 is joined to sections 14 and 16. The hook members 38 may be of a somewhat flexible material so that they may be inserted into recesses 40 to hold the three sections securely in place. The dome 17 rests upon the upper edges of sections 12, 14, 16 which are channeled as shown by numeral 42 in FIG. 4. The lower edge of dome 17 will have a tongue-like extension (not shown) that is received in the channels 42 to retain the dome in place above the lower three sections.

The entrance tunnel 18 and the window elements 26, 28 are secured to their respective sections by a similar tongue and groove arrangement. Thus as seen in FIG. 4, the edge of the entranceway has a tongue 44 that mates with a groove 46 in entrance tunnel element 18. Similarly, the windows 26, 28 have grooves (not shown) that would mate with tongues in the edges of the window openings.

It is seen that the present design provides a sturdy and convenient shell or mold for a snow igloo that can be used to collect snow as it is forming to form a child's toy igloo. When it is not snowing, the shell may be used in a similar manner providing an outdoor winter facility for young children.

Having thus described the invention with particular reference to the preferred forms thereof, it will be obvious that various changes and modifications may be made therein without departing from the spirit and scope of the invention as defined in the appended claims.

What is claimed is:

1. An igloo mold for making a child's snow igloo comprising:

a plurality of curved sections adapted to be secured together at the edges thereof to form the contour of an igloo of substantially hemispherical shape;

a first of said sections having an opening passing therethrough;

curved entry member means secured to said first section at the edge of the opening therethrough and extending outward from the first section to form an entry tunnel;

a second and third of each of said sections, each having an opening passing therethrough;

curved window member means secured to each of said second and third section at the edge of the respective openings therethrough and extending outward to form windows;

the outer surfaces of the plurality of sections having a grid of indentations in the form of the edges of snow blocks whereby snow may be packed on the said outer surfaces and held in place; and the outer surfaces of the plurality of sections being rough to facilitate the sticking thereto of falling snow.

2. The igloo mold of claim 1 in which the outer edge of the entry tunnel is flared outward forming a lip to inhibit snow from falling into the entry tunnel.

3. The igloo mold of claim 1 in which the outer edge of each window member means is flared outward forming a lip to inhibit snow from falling into the respective window.

4. An igloo mold for making a child's snow igloo comprising:

a plurality of curved sections adapted to be secured together at the edges thereof to form the contour of an igloo of substantially hemispherical shape;

a first of said sections having an opening passing therethrough;

curved entry member means having an inner edge and an outer edge;

the inner edge of said curved entry member means being secured to the edge of said opening in the first section and extending outward therefrom to form an entry tunnel;

the outer edge of the curved entry member being flared outward forming a lip to inhibit snow from falling into the entry tunnel;

a second and third of each of said sections each having an opening passing therethrough;

two curved window members means each having an inner edge and an outer edge;

the inner edge of each of said curved window member means being secured to an edge of a respective one of said openings passing through said second and third sections and extending outward to form windows;

the outer edge of each of said curved window member means being flared outward forming a lip to inhibit snow from falling into the respective one edge of each of said plurality of curved sections being flared outward to provide a lip around the base of the igloo to enhance stability thereof;

the outer surfaces of the plurality of sections having a grid of indentations in the form of the edges of snow blocks whereby snow may be packed on the said outer surfaces and held in place; and the outer surfaces of the plurality of sections being rough to facilitate the sticking thereto of falling snow.

* * * * *